US006647912B1

(12) United States Patent
Rogers

(10) Patent No.: US 6,647,912 B1
(45) Date of Patent: Nov. 18, 2003

(54) UNDERWATER TRAVELING CRAFT

(76) Inventor: Thomas W. Rogers, 1534 Rosella Ct., Brentwood, TN (US) 37027

( * ) Notice: Subject to any disclaimer, the term of this patent is extended or adjusted under 35 U.S.C. 154(b) by 19 days.

(21) Appl. No.: 10/039,567

(22) Filed: Jan. 7, 2002

Related U.S. Application Data

(60) Provisional application No. 60/265,350, filed on Feb. 1, 2001.

(51) Int. Cl.[7] ..... B63C 11/46
(52) U.S. Cl. ..... 114/315; 440/6
(58) Field of Search ..... 114/315; 440/6

(56) References Cited

U.S. PATENT DOCUMENTS 5,469,803 A * 11/1995 Gallo ..... 114/315
6,461,204 B1 * 10/2002 Takura et al. ..... 440/6

* cited by examiner

*Primary Examiner*—Ed Swinehart
(74) *Attorney, Agent, or Firm*—Charles M. Kaplan

(57) ABSTRACT

An under water vehicle pulls its user with a motor driven propeller at the front end with the user holding on to the vehicle and steering it from the rear end. The hollow vehicle body has inner and outer walls separated by an air space that provides the necessary buoyancy and strength.

21 Claims, 7 Drawing Sheets

UNDERWATER TRAVELING CRAFT

This application is entitled to the benefit to U. S. Provisional Application No. 60/265,350, filed Feb. 1, 2001.

BACKGROUND OF THE INVENTION

This invention relates generally to underwater propulsion vehicles and more specifically to underwater towing devices for the exploration of underwater environments that pull a swimmer, snorkeler or diver wherever they direct the device underwater or near the surface.

The main problem with conventional underwater propulsion vehicles is that they lack the maneuverability of a design where the propeller pulls the vehicle through the water. Another problem with the prior art devices is that the batteries are contained internally and are often difficult to change. Another problem with the prior art devices is that the propeller is located near the user and therefore is inherently unsafe. Another problem with prior art underwater propulsion devices is that flotation or buoyancy is achieved by an air space in the battery compartment, which is subject to leaking and flooding, thus reducing or eliminating the buoyancy. While some prior art vehicles may be suitable for a specific purpose for which they were designed, they are not particularly suitable for the exploration of underwater environments by pulling a user wherever they direct the craft to go.

OBJECTIVES OF THE INVENTION

Accordingly it is an object of this invention to provide an underwater towing craft for the exploration of underwater environments by pulling the user where ever directed by the user.

Another object is to provide an underwater towing device that is easier to maneuver and is safer because the propeller is at its front.

Another object is to provide a battery powered underwater towing unit that has batteries in a sealed module that can be quickly and easily replaced.

Another object is to provide an underwater towing craft that achieves a predetermined buoyancy by the use of double walled construction providing air spaces between its walls.

Another object is to provide an underwater towing vehicle that is durable, strong, safe, easy to operate and maintain, relatively inexpensive, pleasing in appearance, and which does not have defects inherent in similar prior art vehicles.

Other objects and advantages of vehicles incorporating this invention will be apparent from the specification and claims and the scope of the invention will be set forth in the claims.

DESCRIPTION OF THE INVENTION

Figure 1:
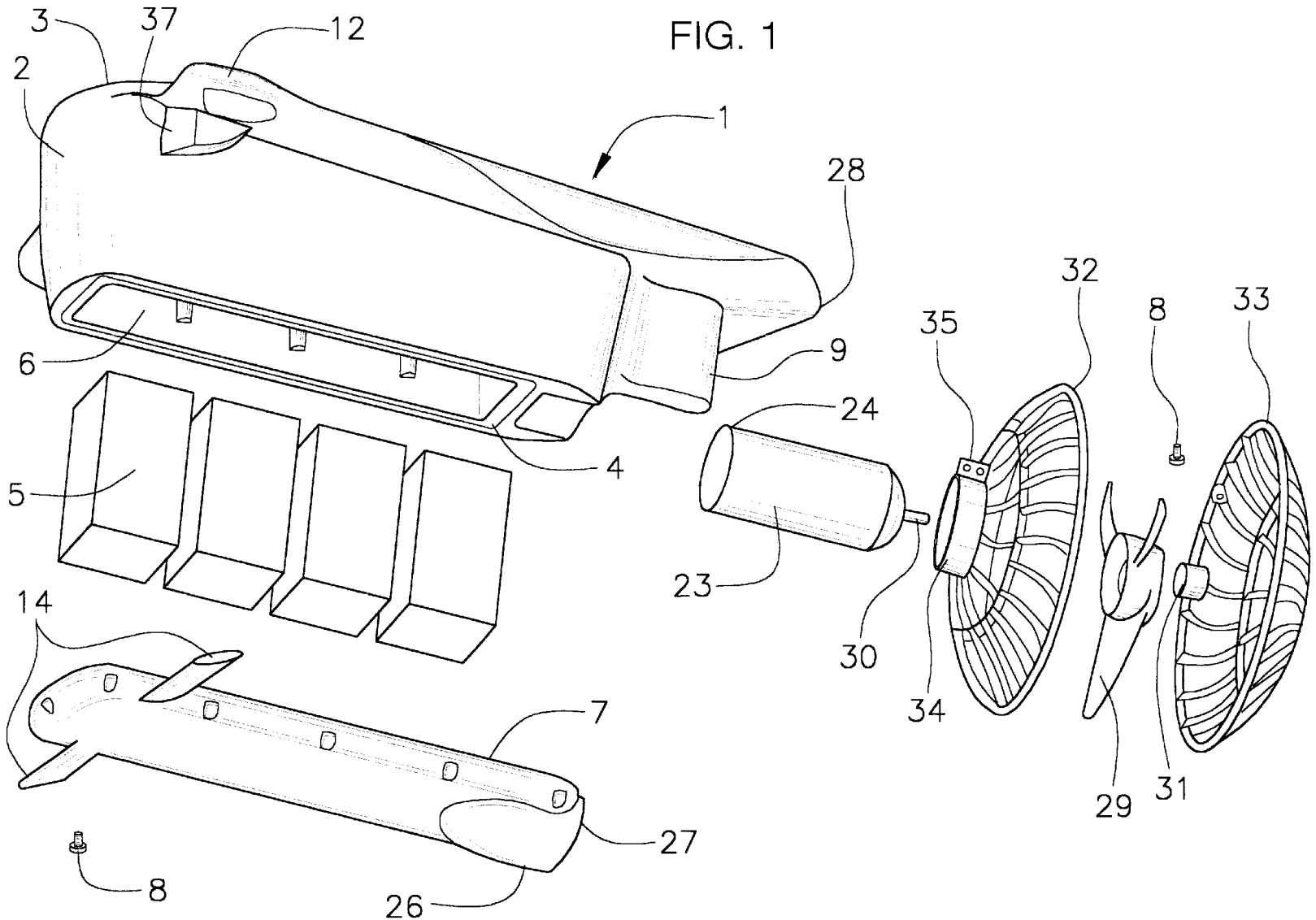
FIG. 1 is an exploded perspective view one embodiment of an underwater towing craft in accord with this invention.
Figure 2:
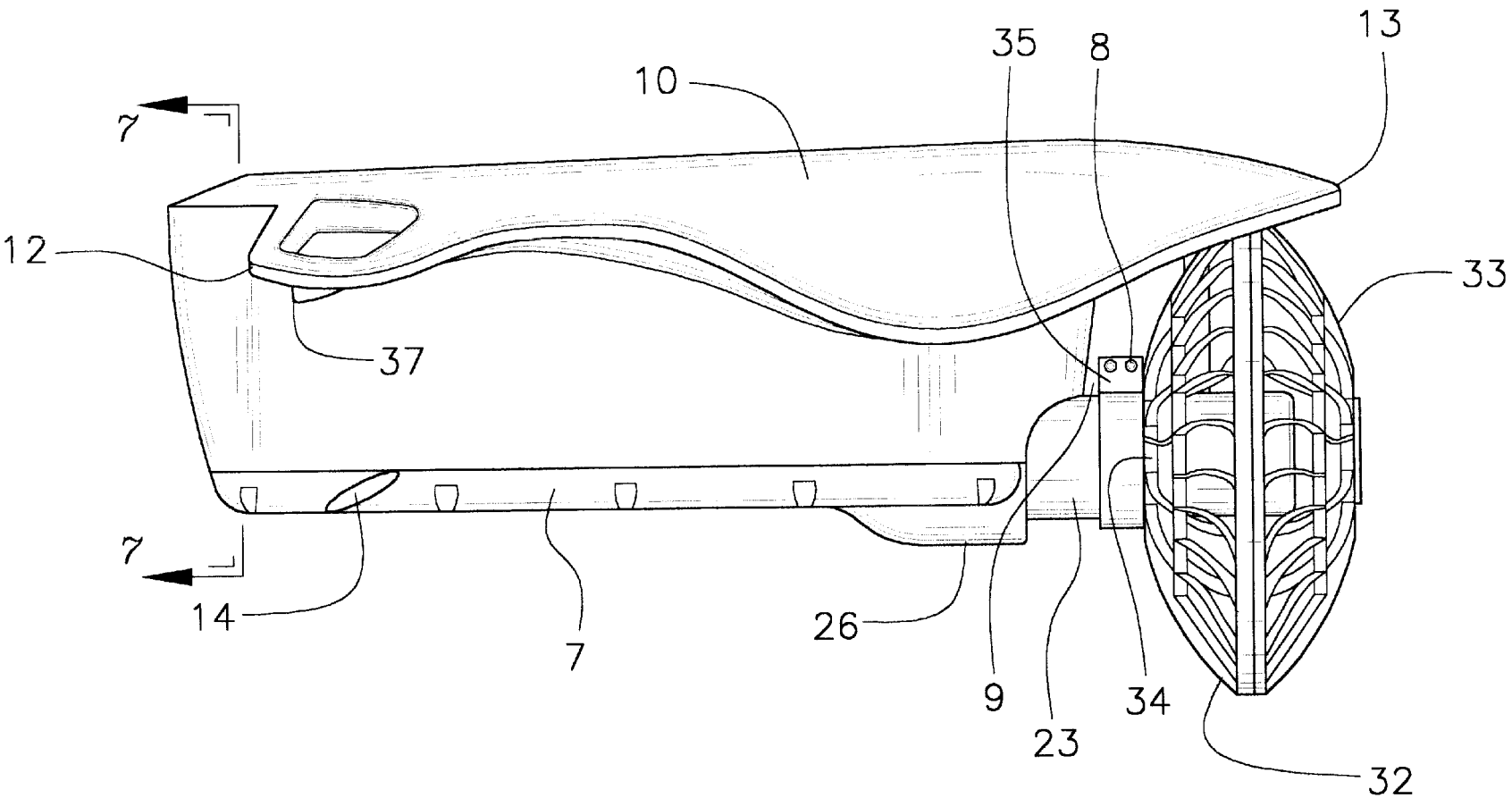
FIG. 2 is a side view of the embodiment shown in FIG. 1.
Figure 3:
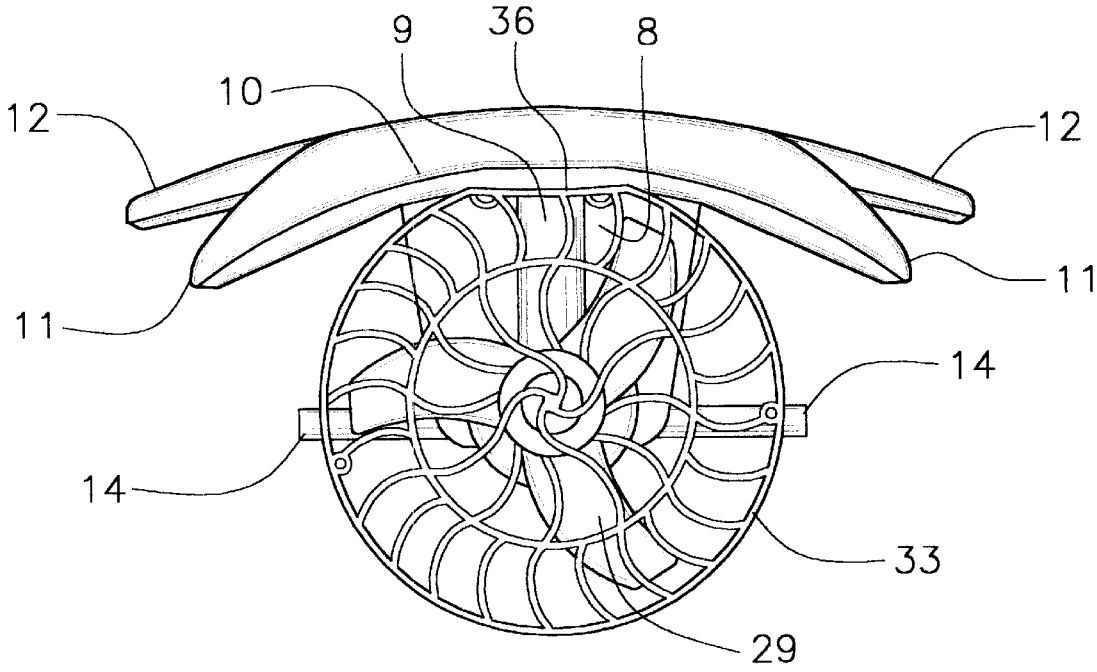
FIG. 3 is a front view of the embodiment shown in FIG. 1.
Figure 4:
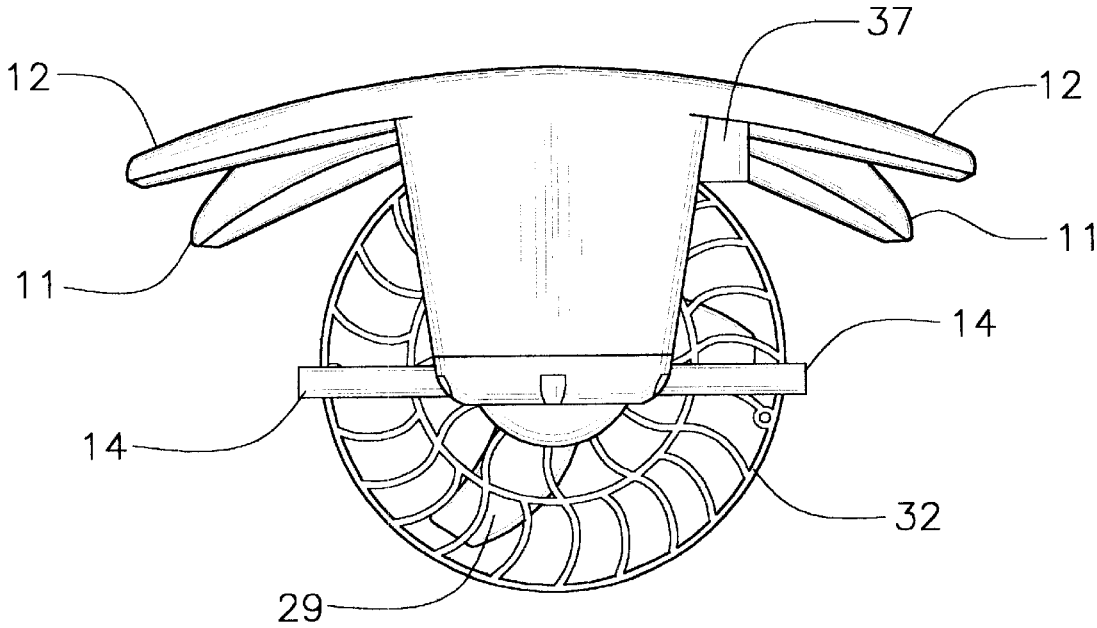
FIG. 4 is a rear view of the embodiment shown in FIG. 1.
Figure 5:
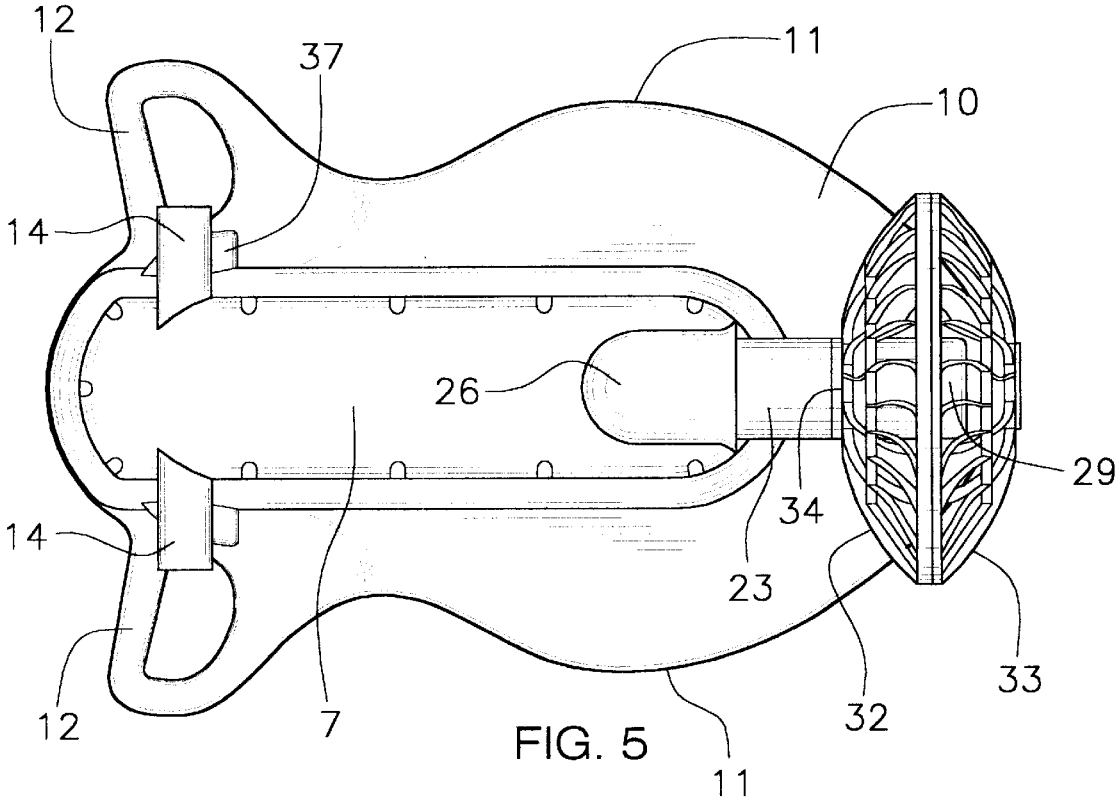
FIG. 5 is a bottom plan view of the embodiment shown in FIG. 1.
Figure 6:
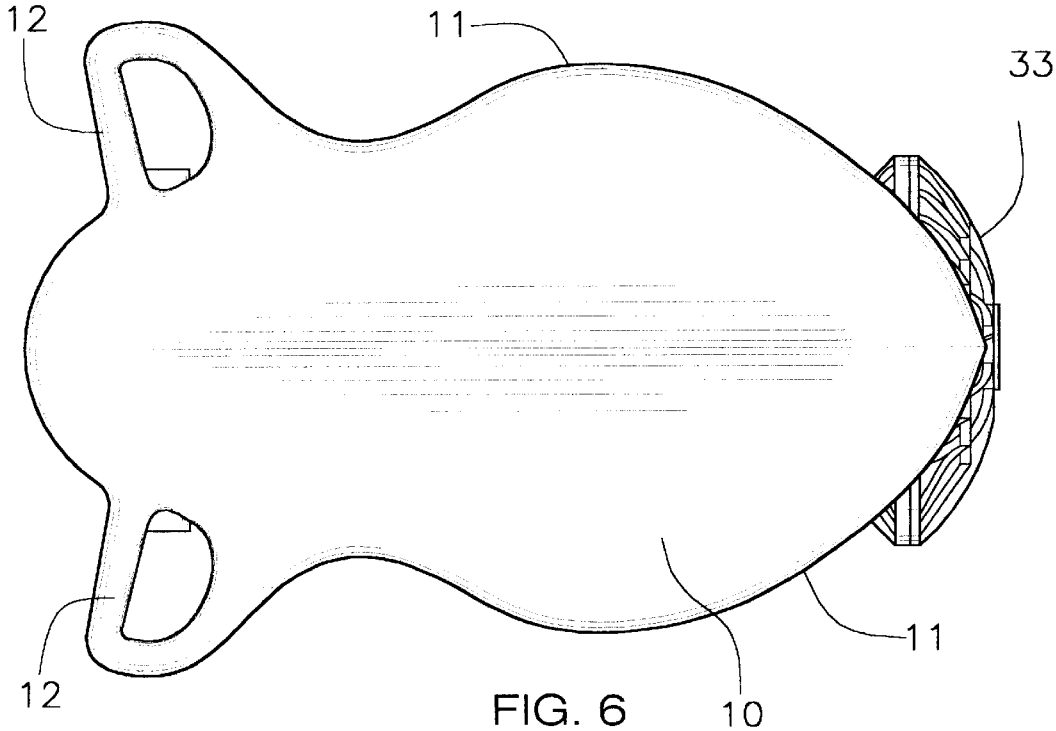
FIG. 6 is a top plan view of the embodiment shown in FIG. 1.
Figure 7:
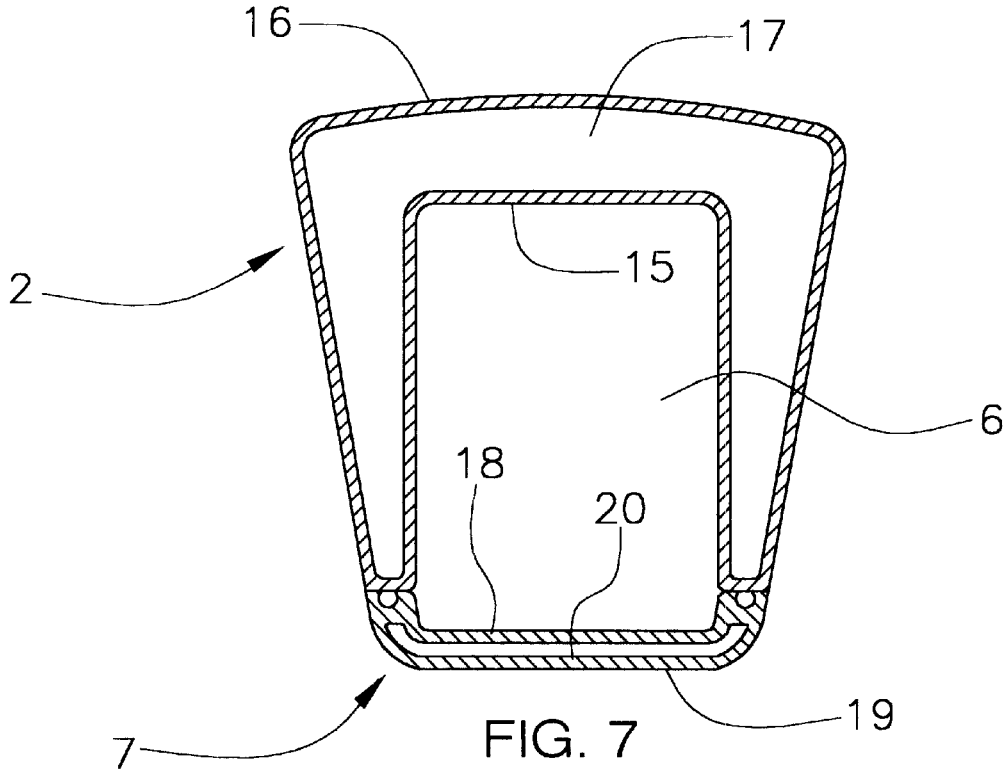
FIG. 7 is an enlarged cross sectional view taken generally along the line 7—7 FIG. 2.

The drawing shows a propeller pulled underwater craft 1 in accord with this invention. A buoyant, elongated hollow plastic body 2 has a closed top end 3 and an open bottom end 4. One or more removable D.C. batteries 5 are contained within a hollow battery compartment 6. The batteries fit:snugly into and fill essentially all of the space in compartment 6 so that the batteries can not move around when the craft 1 is maneuvered in the water. A removable bottom plate 7 provides a water tight closure for compartment 6 and may be attached by suitable fasteners such as screws 8. An integral vertically extending anti cavitation fin 9 is centered on body 2 and projects ahead of compartment 6 in the direction that vehicle 1 travels in the water. The closed hollow top end 3 of the body 2 may be shaped as a hydraulically balanced sled 10 having hollow wings 11 that project laterally beyond the compartment 6 and handles 12 that the user can hold on to and use for maneuvering the craft 1 from its rear end. The front end 13 of sled 10 projects ahead of compartment 6 and fin 9. Fixed or adjustable diving fins 14 may be provided on plate 7.

Buoyancy and strength are, achieved by the wall structure of the body 2 and bottom plate 7. The body 2 has an inner wall 15 and an outer wall 16 that are separated by an air space 17. The bottom plate 7 has an inner wall 18 and an outer wall 19 that are separated by an air space 20. The volume of air in the spaces 17 and 20 may be predetermined so as to provide craft 1 with a predetermined specific gravity that will cause the craft to sink, or float in water, or to barely float (e.g. 0.99).

A cylindrical, sealed D. C. electric motor 23 has its rear end 24 supported in a cylindrical cradle 26 at the front end 27 of the bottom plate 7. A propeller 29 is attached to the shaft 30 of motor 23 by a nut 31. Shaft 30 extends ahead of motor 23 toward the front end 28 of the vehicle 1 in the direction of travel. A pair of nesting grids or screens 32 and 33 surround and protect propeller 29. A circular ring 34 is centered on screen 32. Ring 34 receives and supports motor 23. Tabs 35 that project from ring 34 are attached to fin 9 by screws 8 so as to support the motor and screen on the body 2. The upper end 36 of the screens 32 and 33 may be shaped to fit flush against the underside of sled 10 so that screws 8 passing through holes in the screens into the sled provide additional support for the propeller and motor assembly.

Operation of the motor 23 may be controlled by a conventional on-off switch 37 and conventional speed control circuitry. The switch 37 should be spring loaded so that the motor turns off when it is released by the user.

Figure 8:
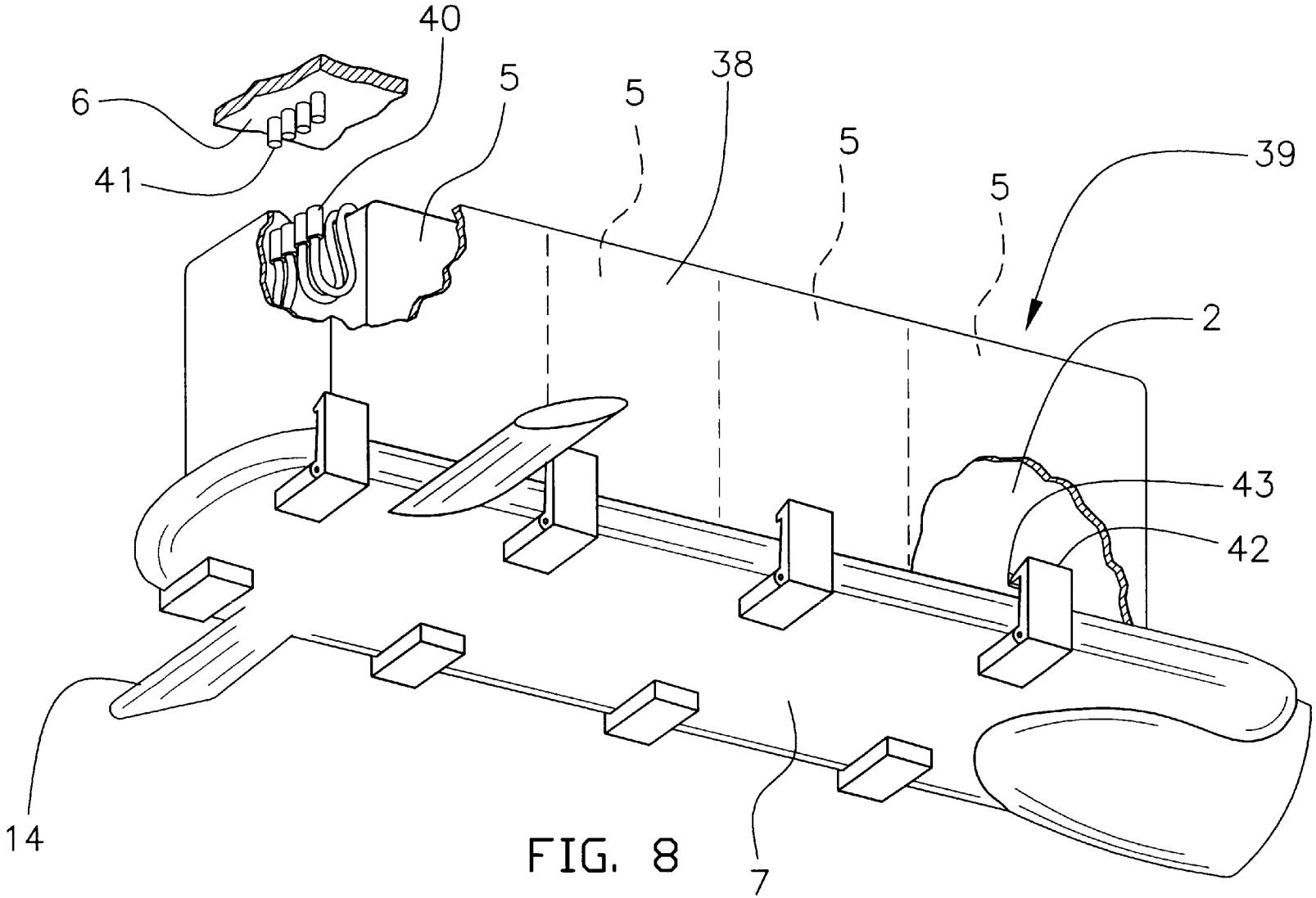
FIG. 8 is a perspective partially broken away, exploded partial view of another embodiment of the invention.

FIG. 8 shows another embodiment that is essentially identical to that shown in FIGS. 1–7, except that a plurality of batteries identical to the batteries 5 may be sealed together inside of a unitary plastic casing 38 and then attached to bottom plate 7 to form a single battery module 39. Female electrical connectors 40 mate with male connectors 41 inside of compartment 6 for connecting the batteries to the motor 23. Quick release latches 42 on the bottom 7 mate with slots 43 on the outside of compartment 6 for holding the combined bottom plate 7 and battery module 39 in place.

Figure 9:
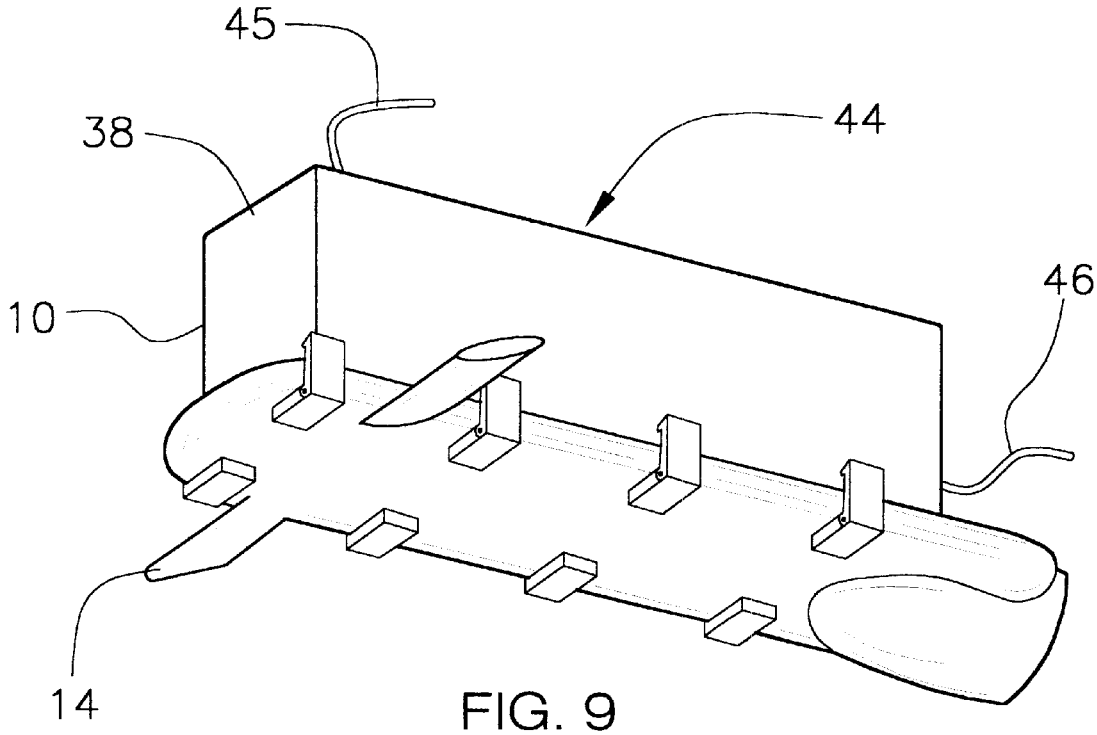
FIG. 9 is a perspective partial view of another embodiment of the invention.

FIG. 9 shows another module 44 that is essentially identical to the module 39 in FIG. 8 except that the female and male electrical connectors 40 and 41 have been replaced by a waterproof pig tail wire 45 that extends from the module 44 for connection to the motor 23, and another pig tail wire 46 is provided for connection to the switch 37.

Figure 10:
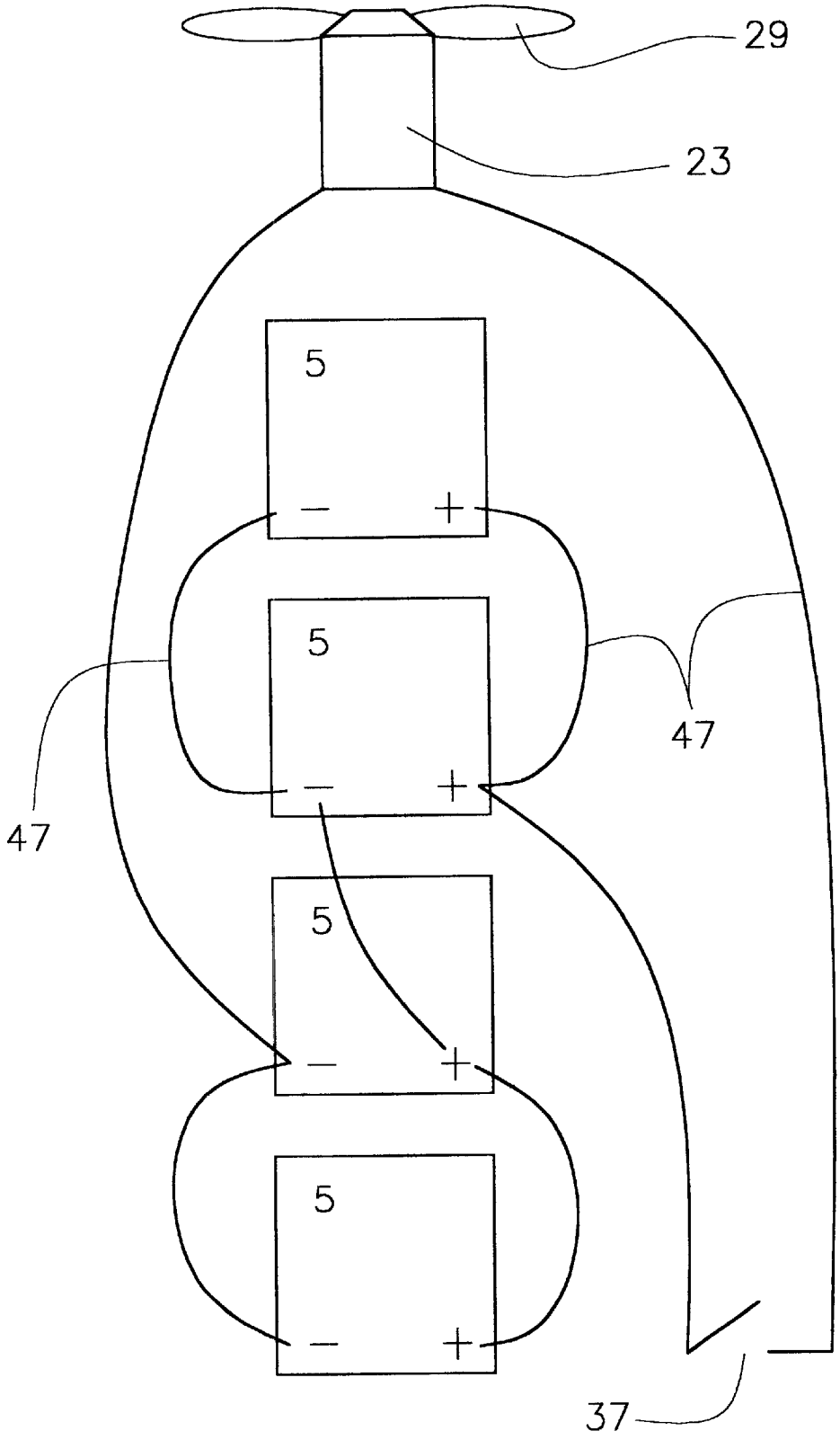
FIG. 10 is a schematic wiring diagram.

The wiring diagram in FIG. 10 shows how the individual batteries 5 would be connected by wires 47 to the switch 37 and motor 23. The electrical connections for the batteries in the module 39 and 44 would be the same as those shown in FIG. 10.

The craft 1 operates by having the user place the craft in the water with him or her and by grasping the body 2 at the handles 12 and closing the switch 37. This completes the electric circuit sending power from the batteries 5 through the wiring 47 to the motor 23, which in turn begins to rotate the propeller 29 creating a forward thrust pulling the craft and user forward through the water. The user can exert various forces on the handles 12 to cause changes in direction. Exerting a downward force on the handles 12 causes the craft 1 to rise in the water. Exerting an upward force on the handles 12 causes the craft to dive deeper in the water. By placing a downward force one one handle and an upward force on the other handle, the user will cause the craft to rotate along its lateral axis. This rotation can continue until the user maneuvers a complete 360 degree roll, or until the user decides to stop. Combinations of forces on the handles 12 create an unlimited amount of maneuverability in the water. For example, by placing downward force on the right handle and upward force on the left handle, the craft 1 will begin to rotate in a clockwise manner, as viewed from the user's position. As the unit approaches 90 degrees of rotation, the user could transition the force on the left handle to a downward force and cause the craft to maneuver in a turn along a horizontal plane to change its direction. The craft 1 can be maneuvered in water for recreation, exploration, underwater fishing, and work related tasks.

With respect to the above description, it should be realized that the optimum dimensional relationships for the parts of the invention, to include variations in size, materials, shape, form, function and manner of operation, assembly and use are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the inventions.

What is claimed is:

1. A vehicle for towing a person underwater in a direction of travel controllable by such person using said vehicle, comprising: said vehicle having a front end extending in said direction of travel, an electric motor having a shaft that extends ahead of said motor in said direction of travel, a propeller attached to said shaft adjacent the front end of said vehicle, said propeller being located entirely outside of said vehicle so that rotation of said propeller creates a forward thrust at said front end for pulling said vehicle and such person using said vehicle in said direction of travel.

2. The underwater towing vehicle defined in claim 1, further comprising: a battery compartment, a hydraulically balanced sled that is integral with said battery compartment, said sled being located above said battery compartment and having wings that project laterally beyond said battery compartment, said electric motor being located below said sled and ahead of said battery compartment in said direction of travel of said vehicle, an electric circuit for connecting said motor to batteries in said compartment, a removable plate closing said battery compartment and sealing said batteries inside of said battery compartment, handles adjacent the rear end of said vehicle adapted to be held by such person using said vehicle for maneuvering said vehicle, and a switch in said electric circuit adjacent said handles for activating said motor by such person using said vehicle.

3. A vehicle for towing a person underwater in a direction of travel controllable by such person using said vehicle, comprising: said vehicle having a front end extending in said direction of travel, an electric motor having a shaft that extends ahead of said motor in said direction of travel, a propeller attached to said shaft adjacent the front end of said vehicle for pulling said vehicle and such person using said vehicle in said direction of travel, a battery compartment, a hydraulically balanced sled that is integral with said battery compartment, said sled being located above said battery compartment and having wings that project laterally beyond said battery compartment, said electric motor being located below said sled and ahead of said battery compartment in said direction of travel of said vehicle an electric circuit for connecting said motor to batteries in said compartment, handles adjacent the rear end of said vehicle adapted to be held by such person using said vehicle for maneuvering said vehicle, a switch in said electric circuit adjacent said handles for activating said motor by such person using said vehicle, and a circular ring circumscribing said motor and attaching said motor to said vehicle ahead of said battery compartment in said direction of travel.

4. The underwater towing vehicle defined in claim 3, further comprising: an anti cavitation fin centered on the underside of said sled, and said circular ring being attached to said anti cavitation fin.

5. The underwater towing vehicle defined in claim 3, further comprising: a protective screen surrounding said propeller and said circular ring being attached to said protective screen.

6. A vehicle for towing a person underwater in a direction of travel controllable by such person using said vehicle, comprising: said vehicle having a front end extending in said direction of travel, an electric motor having a shaft that extends ahead of said motor in said direction of travel, a propeller attached to said shaft adjacent the front end of said vehicle for pulling said vehicle and such person using said vehicle in said direction of travel, a battery compartment, and a cylindrical cradle at the front end of said battery compartment, one end of said electric motor being received in and supported by said cylindrical cradle.

7. A vehicle for towing a person underwater in a direction of travel controllable by such person using said vehicle, comprising: said vehicle having a front end extending in said direction of travel, an electric motor having a shaft that extends ahead of said motor in said direction of travel, a propeller attached to said shaft adjacent the front end of said vehicle for pulling said vehicle and such person using said vehicle in said direction of travel, a battery compartment, a hydraulically balanced sled that is integral with said battery compartment, said sled being located above said battery compartment and having wings that project laterally beyond said battery compartment, said electric motor being located below said sled and ahead of said battery compartment in said direction of travel of said vehicle, an electric circuit for connecting said motor to batteries in said compartment, handles adjacent the rear end of said vehicle adapted to be held by such person using said vehicle for maneuvering said vehicle, a switch in said electric circuit adjacent said handles for activating said motor by such person using said vehicle, a removable plate sealing said battery compartment, a plurality of batteries sealed together inside of a unitary plastic casing and attached to said removable plate so as to define a battery module that permits installation and removal of all batteries as a single unit.

8. A vehicle for towing a person underwater in a direction of travel controllable by such person using said vehicle, comprising: said vehicle having a front end extending in said direction of travel, an electric motor having a shaft that extends ahead of said motor in said direction of travel, a propeller attached to said shaft adjacent the front end of said vehicle for pulling said vehicle and such person using said vehicle in said direction of travel, a battery compartment, a hydraulically balanced sled that is integral with said battery compartment, said sled being located above said battery compartment and having wings that project laterally beyond said battery compartment, said electric motor being located below said sled and ahead of said battery compartment in said direction of travel of said vehicle, an electric circuit for connecting said motor to batteries in said compartment, handles adjacent the rear end of said vehicle adapted to be held by such person using said vehicle for maneuvering said vehicle, a switch in said electric circuit adjacent said handles for activating said motor by such person using said vehicle, an anti cavitation fin centered on the underside of said sled, a circular ring circumscribing said motor and attaching said motor to said anti cavitation fin ahead of said battery compartment in said direction of travel, a protective screen surrounding said propeller, said circular ring being attached to said protective screen, a removable bottom plate sealing said battery compartment at its underside, a cylindrical cradle at the front end of said removable battery compartment, and one end of said electric motor being received in and supported by said cylindrical cradle.

9. A vehicle for towing a person underwater in a direction of travel controllable by such person using said vehicle, comprising: said vehicle having a front end extending in said direction of travel, an electric motor having a shaft that extends ahead of said motor in said direction of travel, a propeller attached to said shaft adjacent the front end of said vehicle for pulling said vehicle and such person using said vehicle in said direction of travel, a battery compartment, a hydraulically balanced sled that is integral with said battery compartment, said sled being located above said battery compartment and having wings that project laterally beyond said battery compartment, said electric motor being located below said sled and ahead of said battery compartment in said direction of travel of said vehicle, an electric circuit for connecting said motor to batteries in said compartment, handles adjacent the rear end of said vehicle adapted to be held by such person using said vehicle for maneuvering said vehicle, a switch in said electric circuit adjacent said handles for activating said motor by such person using said vehicle, said battery compartment and sled having an inner wall and an outer wall, said inner and outer walls being separated by an air space that provides a predetermined buoyancy for said vehicle.

10. The underwater towing vehicle defined in claim 9, further comprising: a removable plate sealing said batteries inside of said battery compartment.

11. The underwater towing vehicle defined in claim 9, further comprising: an anti cavitation fin centered on the underside of said sled, and said motor being connected to and supported by said anti cavitation fin.

12. A vehicle for towing a person underwater, comprising: a buoyant elongated hollow body having a closed top and an open end, a battery compartment below said closed top, a removable plate sealing said battery compartment and closing said open end, a removable battery in said battery compartment, said battery substantially filling said battery compartment so that said battery can not move around when said vehicle is in motion, said elongated body having an inner wall and an outer wall, said inner and outer walls being separated by an air space that provides buoyancy for said vehicle, said hollow body comprising a hydraulically balanced sled that is integral with said battery compartment, said sled being located above said battery compartment and having wings that project laterally beyond said battery compartment, said sled including the projecting wings having an inner wall and an outer wall, and said inner and outer walls of said sled and said projecting wings being separated by an air space that also provides buoyancy for said vehicle.

13. The underwater towing vehicle defined in claim 12, further comprising: a plurality of batteries in said battery compartment being sealed together inside of a unitary plastic casing that is attached to said removable plate so as to define a battery module that permits installation and removal of all batteries as a single unit.

14. A vehicle for towing a person underwater in a direction of travel controllable by such person, comprising: an elongated buoyant hollow body having battery compartment, said battery compartment having a closed top and an open bottom, a removable bottom plate sealing the open bottom of said battery compartment, a plurality of removable batteries in said battery compartment, said batteries substantially filling all of said battery compartment so that said batteries can not move around when said vehicle is in motion, said hollow body having an inner wall and an outer wall, and said inner and outer walls being separated by an air space that provides buoyancy for said vehicle to prevent said vehicle from sinking in water, an electric motor located ahead of said battery compartment in said direction of travel of said vehicle, an electric circuit connecting said motor to Said batteries in said compartment, said motor having a shaft that extends ahead of said motor in said direction of travel, a propeller attached to said shaft at the front end of said vehicle for pulling said vehicle and such person using said vehicle in said direction of travel, handles at the rear end of said vehicle adapted to be held by such person using said vehicle for maneuvering said vehicle, and a switch in said electric circuit adjacent said handles for activating said motor by such person using said vehicle.

15. The underwater towing vehicle defined in claim 14, further comprising: a hollow hydraulic sled that is integral with and above said battery compartment, an open ended cradle defined by an end of said removable bottom plate, one end of said electric motor being supported in said cradle, a ring attached to said elongated body below said hydraulic sled, said ring surrounding said motor and supporting an opposite end of said motor.

16. The underwater towing vehicle defined in claim 15, further comprising: an anti cavitation fin centered on the underside of said sled, and said ring being attached to said anti cavitation fin.

17. The underwater towing vehicle defined in claim 14, further comprising: said batteries being sealed together inside of a unitary plastic casing so as to define a battery module that permits installation and removal of all batteries as a single unit.

18. The underwater towing vehicle defined in claim 14, further comprising: a hydraulic sled that is integral with and above said battery compartment, an open ended cradle defined by an end of said removable bottom plate, one end of said electric motor being supported in said cradle, a protective screen surrounding said propeller, a ring attached to said protective screen below said hydraulic sled, an anti cavitation fin centered on the underside of said sled, said ring being attached to said anti cavitation fin and surrounding said motor for supporting an opposite end of said motor.

19. The underwater towing vehicle defined in claim 14, further comprising: a hollow hydraulically balanced sled that is integral with and located above said battery compartment, said sled having wings that project laterally beyond said battery compartment, an open ended cylindrical cradle defined by an end of said removable bottom plate, one end of said electric motor being supported in said cylindrical cradle, a protective screen surrounding said propeller, a circular ring attached to said protective screen below said hydraulic sled, a vertically extending anti cavitation fin centered on the underside of said sled, said circular ring being attached to said anti cavitation fin and surrounding said motor for supporting an opposite end of said motor.

20. A vehicle for towing a person under water comprising: an electric motor, a battery compartment in said vehicle, a plurality of separate self contained batteries in said battery compartment for energizing said motor all of said, separate self contained batteries being sealed together inside of a unitary plastic casing so as to define a single battery module that permits installation and removal of all of said plurality of separate self contained batteries as a single integral unit.

21. The underwater towing vehicle defined in claim 20, further comprising: said battery compartment having an open end, a removable plate sealing said open end, and said single battery module being attached to and removable with said plate.

* * * * *